United States Patent [19]

Faustini

[11] 4,381,759

[45] May 3, 1983

[54] FIREPLACE HEAT EXCHANGER APPARATUS AND METHOD

[76] Inventor: Carlo Faustini, 13020 Tamarack Rd., Silver Spring, Md. 20904

[21] Appl. No.: 167,368

[22] Filed: Jul. 10, 1980

[51] Int. Cl.[3] ..... F24B 7/00; F24F 3/14

[52] U.S. Cl. ..... 126/121; 126/134; 126/131; 126/164; 126/152 B

[58] Field of Search ..... 126/120, 121, 131, 134, 126/163 R, 164, 165, 152 B, 113, 132, 313; 237/51, 78, 55; 261/125

[56] References Cited

U.S. PATENT DOCUMENTS 1,747,259 2/1930 Pierce ..... 126/134

4,191,161 3/1980 Kling ..... 126/134

4,241,719 12/1980 Vickery ..... 126/134

4,258,879 3/1981 Nischwitz ..... 126/164

*Primary Examiner*—James C. Yeung

*Attorney, Agent, or Firm*—Epstein & Edell

[57] ABSTRACT

A fireplace heat exchanger apparatus and method utilizes a tubular grate for holding fuel to be burned having a bottom portion for collecting a liquid such that the liquid will be vaporized by the heat from the fuel burned in the grate and carried into a space to be heated by air forced through the tubular grate to substantially increase the amount of heat obtained from burning of fuel.

18 Claims, 4 Drawing Figures

FIG. 4
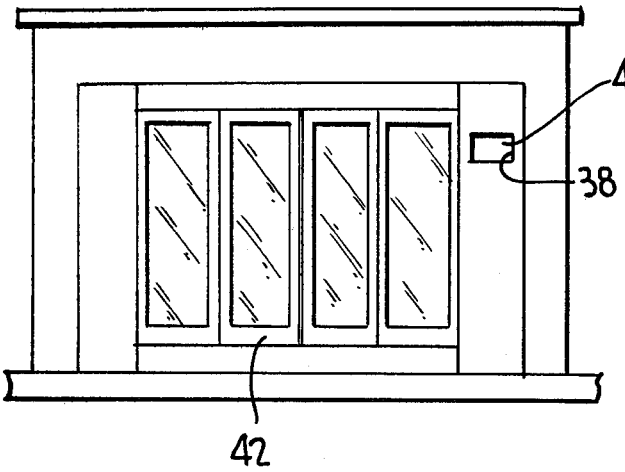
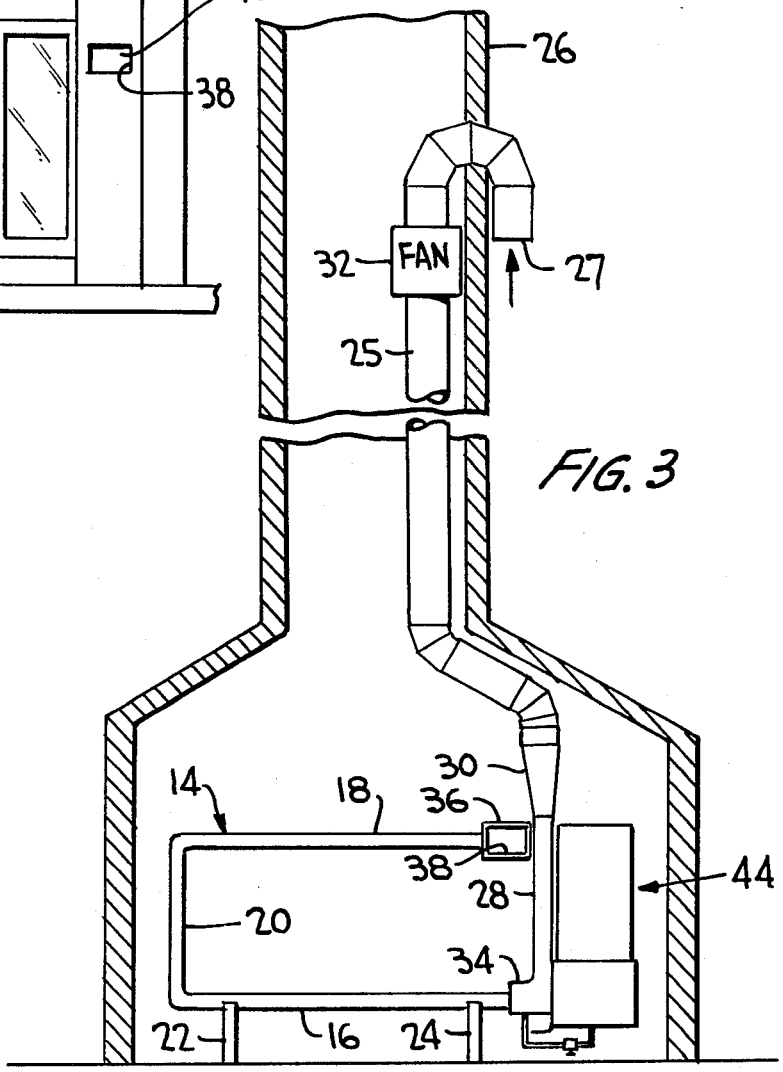
FIG. 3

FIREPLACE HEAT EXCHANGER APPARATUS AND METHOD

BACKGROUND OF THE INVENTION

1. Field of the Invention

The present invention pertains to heat exchanger apparatus and method for use in fireplaces and, more particularly, to heat exchangers having air forced therethrough for heating a space.

2. Discussion of the Prior Art

The use of forced air heat exchangers in fireplaces for increasing the heating efficiency thereof is well known; however, the amount of heat delivered to a space to be heated by such heat exchangers has, in the past, been limited and inadequate to render the fireplace an acceptable heating installation. Prior art attempts to utilize forced air heat exchangers in fireplaces or stoves have suffered some or all of the disadvantages of being relatively inefficient, utilizing air from the space to be heated for combustion thereby creating a draft and causing external air to be drawn into this space, producing dry air requiring humidification, and permitting too much heat to escape up the chimney or flue thereby creating an inefficient system.

SUMMARY OF THE INVENTION

Accordingly, it is a primary object of the present invention to overcome the above-mentioned disadvantages of the prior art by providing a fireplace heat exchanger apparatus and method producing moisturized or humidified hot air with high efficiency.

Another object of the present invention is to utilize a liquid, such as water, to increase the efficiency of a forced air fireplace heat exchanger by vaporizing the water in a tubular grate of the heat exchanger such that the air forced through the tubular grate carries the vaporized water therewith for expelling into a space to be heated.

A further object of the present invention is to supply outside air to a tubular grate of a heat exchanger, the outside air passing through a duct in a flue of a fireplace thereby absorbing heat from hot effluent gases, the forced air also being supplied to a position below the tubular grate to aid combustion.

An additional object of the present invention is to maintain a predetermined level of liquid in a tubular grate of a heat exchanger to provide continuous humidified air with high efficiency.

The present invention has another object in that vaporized water is used with heated air to increase the heating efficiency of fuel burned in a fireplace, the specific heat of the water being substantially greater than that of air to increase the heat extracted from the fuel.

Some of the advantages of the present invention over the prior art are that efficiency of a forced air heat exchanger is substantially increased by vaporizing liquid therein, outside air is utilized as a supply of forced air for the heat exchanger and for combustion to create a positive pressure in the space to be heated, the heat exchanger can operate continuously with an automatically controlled level of liquid to be heated therein, and the heat exchanger can be simply and inexpensively manufactured and installed in existing fireplaces to substantially increase the efficiency thereof.

The present invention is generally characterized in a heat exchanger for use in a fireplace or stove to heat a space including a tubular grate for holding fuel to be burned and for receiving air and liquid to be heated and expelling the heated air and liquid into the space to be heated, the tubular grate having a bottom portion collecting the liquid, and liquid supply means for feeding a liquid to the bottom portion of the tubular grate whereby the liquid will be vaporized by the heat from fuel burned in the tubular grate and carried into the space to be heated with the air heated in the tubular grate.

The present invention is further generally characterized in a heat exchanging method for heating a space from heat generated by fuel burned on a tubular grate in a fireplace including the steps of supplying liquid to the tubular grate to be vaporized by the heat generated in the fireplace, forcing air through the tubular grate to entrain the liquid vapor therein, and expelling the heated liquid vapor and air into the space to be heated.

Other objects and advantages of the present invention will become apparent from the following description of the preferred embodiment taken in conjunction with the accompanying drawings.

BRIEF DESCRIPTION OF THE DRAWINGS

FIG. 3 is an elevation illustrating the heat exchanger of the present invention in a fireplace.

FIG. 4 is a front elevation of a fireplace utilizing the heat exchanger of the present invention having closed doors.

DESCRIPTION OF THE PREFERRED EMBODIMENT

Figure 1:
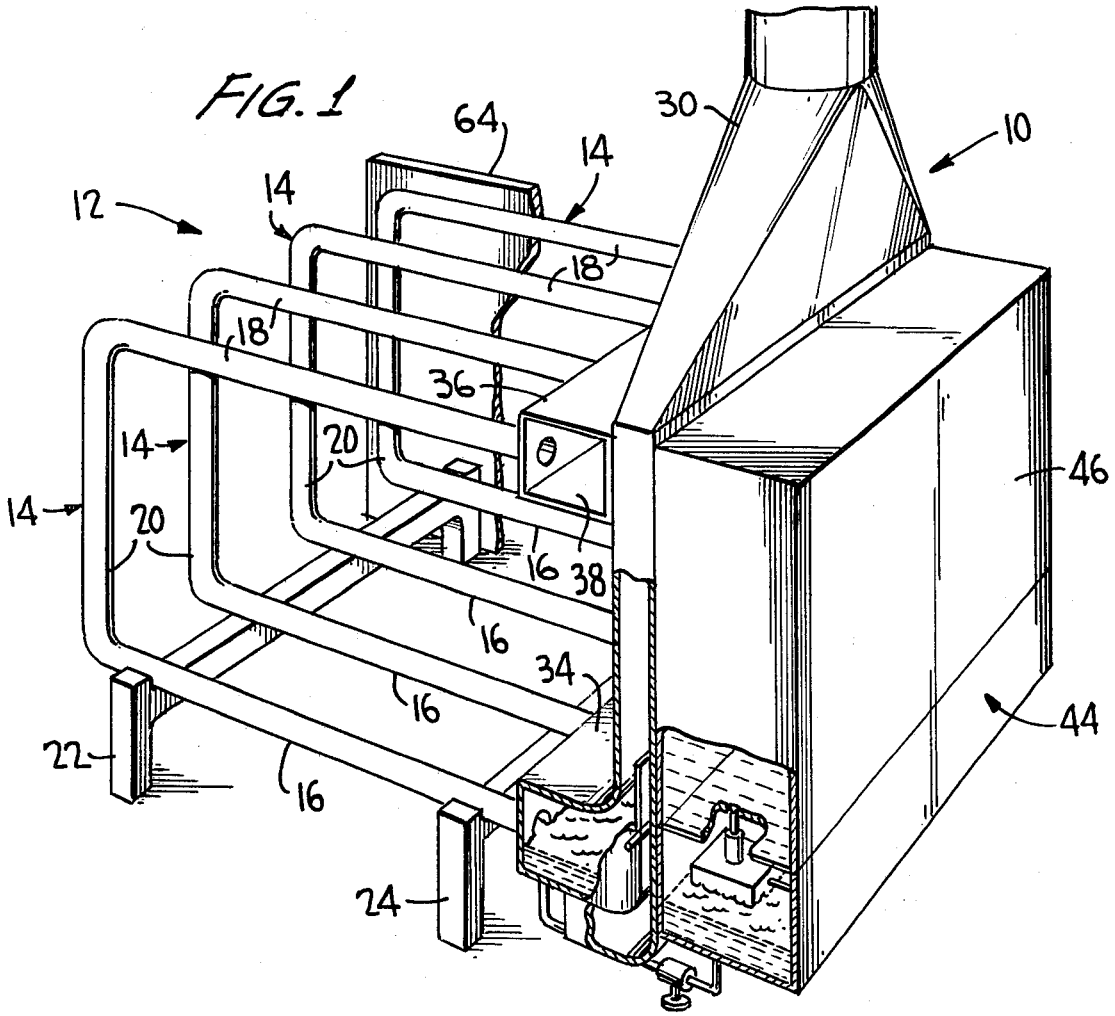
FIG. 1 is a broken perspective view of a heat exchanger according to the present invention.
Figure 2:
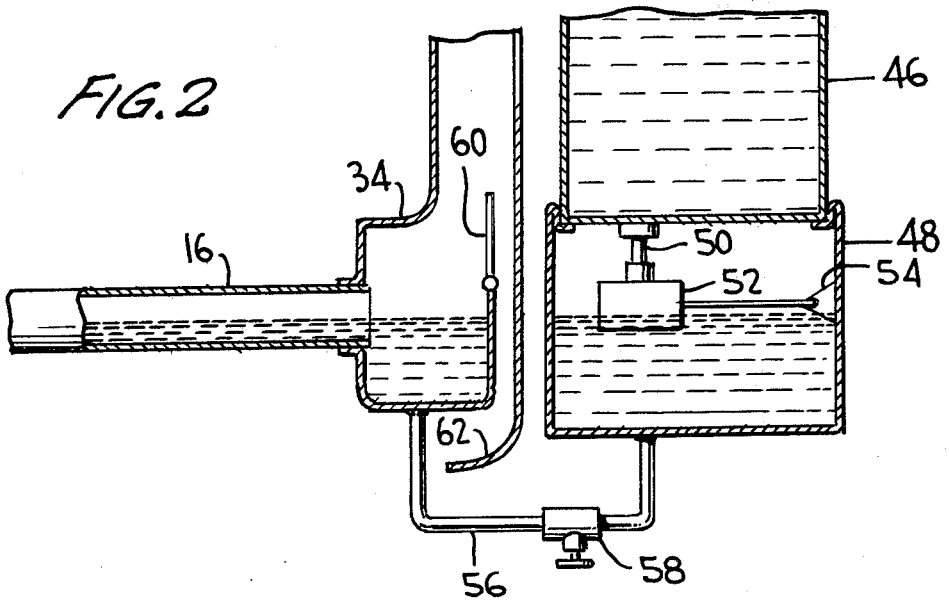
FIG. 2 is a side elevation partly in section illustrating the liquid supply for the heat exchanger of the present invention.

A heat exchanger 10 for use in a fireplace to heat a space, such as a room in a building, in accordance with the present invention is illustrated in FIG. 1 and includes a tubular grate 12 formed of a plurality of tubular members 14 each having an elongated C-shape in side elevation to define horizontal bottom legs or portions 16, horizontal top legs or portions 18 and upstanding vertical legs 20 extending therebetween. The bottom portions 16 of the tubular grate rest on spaced supports 22 and 24 such that the tubular grate 12 is raised above the floor of a fireplace in which the heat exchanger 10 is installed. The heat exchanger of the present invention is described herein for use in a fireplace; however, it will be appreciated that the heat exchanger can be used with various heating appliances designed to extract heat from wood, coal or similar fuels burned in or on a grate to heat a space or room, such as a freestanding stove.

Air is supplied to the tubular grate and the fuel burning area via a duct 25 vertically extending along a flue or chimney 26 of the fireplace to an inlet 27 disposed at a location external of the space to be heated, the duct communicating with a plenum 28 extending along the open side of the grate 12 via a transition section 30, as best illustrated in FIG. 3. Air is directed through the duct 25 to the plenum 28 by a fan 32 disposed along the chimney. Plenum 28 communicates with a lower manifold 34 which, in turn, communicates with the bottom portions 16 of the tubular members 14 of the grate 12. An upper manifold 36 communicates with the upper portions 18 of the tubular grate members 14 and has an open end 38 for extending through a corresponding opening 40 in a closure for a fireplace in which the heat exchanger 10 is to be installed, the upper manifold communicating with the opening either directly or via a suitable flexible duct (not shown). The upper manifold is disposed above and spaced from the lower manifold and is mounted on the plenum 28. The fireplace closure desirably is formed with hinged doors 42, as illustrated in FIG. 4, to prevent air from the space to be heated from entering the fireplace while permitting the doors to be opened for placing fuel in the grate 12.

Liquid, such as de-mineralized water, is supplied to the lower manifold 34 and the lower portions 16 of the tubular grate members by a liquid supply 44 disposed adjacent the plenum and including a tank 46 disposed over and supported on a reservoir 48, the tank 46 having an outlet tube 50 extending from a bottom wall thereof. A float valve 52 is pivotally mounted at 54 on a side wall of the reservoir 48 and is movable to seal the end of tube 50 to prevent flow from the tank 46 into the reservoir; and, as the level of liquid in the reservoir is reduced, the float valve 52 will move away from the tube 50 to permit flow of liquid into the reservoir from the tank to thereby maintain a predetermined constant level of liquid therein. Communication between the reservoir 48 and the lower manifold 34 is established by a pipe 56 having an on/off valve 58 therein, it being appreciated that, with the valve 58 open, the level of liquid maintained in the reservoir will be the same as the level of liquid maintained in the bottom portion of the tubular grate members and the lower manifold 34. Within the lower manifold 34 is an adjustable baffle 60 which permits air to be supplied to an area below the grate 12 via a curved deflector 62 as well as supplying air to the tubular grate for heating. A metal plate 64 can be disposed along the rear of the grate to prevent heat loss therefrom and reflect radiant heat back into the grate.

The tubular members 14 of the grate 12 are disposed in parallel relation and with the manifolds and plenum 28 form an oven-like cavity within which firewood, coal or other fuel is burned, the back of the oven-like cavity being closed by plate 64 to maintain more of the heat generated by the fire within the oven-like cavity while the front of the oven-like cavity is open for loading firewood therein. The use of a plurality of tubular member bottom portions extending in parallel relation from the lower manifold provides a support for fuel to be burned and a large surface receptacle for collecting water for vaporization; however, the grate 12 could be made with various tubular configurations in accordance with the present invention as long as a botton portion for collecting water is provided thereby.

In operation, the heat exchanger 10 is installed in a fireplace with the duct 25 extending through the flue thereof, such as a chimney or a stovepipe flue. When the fan 32 is operated, air is drawn from the external location, preferably the outdoors, and supplied to the plenum 28 and the lower manifold 34, a portion of the air being forced through the tubular members 14 and another portion being supplied beneath the grate to aid in combustion of fuel, such as firewood or coal, placed in the oven-like cavity formed by the grate. The tank 46 is filled with water to also fill the reservoir 48 to the predetermined level, and water from the reservoir is supplied to the lower manifold 34 and the bottom portion of the tubular grate members by opening valve 58 which permits the level of water in the lower manifold and tubular members to reach the same level as maintained in the reservoir 48. The water is maintained at a level to keep the tubular members partially filled, preferably one-third filled. The heat generated by the fire is transferred to the tubular members 14, the manifolds 34 and 36 and the vertical chamber 28 by conduction, convection and irradiation, and when the fuel in the tubular grate 12 is burned, the heat therefrom will vaporize the water, and the air forced through the tubular grate will carry the vaporized water through the tubular members and the upper manifold 36 into the space to be heated via opening 40 in the closure 42 for the fireplace. The vaporized water in the air forced into the space not only moisturizes or humidifies air supplied to the space for heating, but increases the heat transfer thereform, as will be explained hereinafter.

Most fireplace heat exchangers use air as the primary medium by which heat produced by the fire is transferred to a space to be heated. The amount of heat that can be transferred by this method is limited in that, for instance, an air flow of 60 $m^3$ (about 2100 cu. ft.) per hour can transfer only about 2226 BTU's/hour if the temperature of the air is raised by 54° F. (30° C.) while going through the heat exchanger. This can be determined by the formula:

$$\Delta Q = K \cdot V \cdot \Delta T,$$

where $\Delta Q$ = quantity of heat transferred per time unit,

K = a constant (related to specific heat),

V = volume of air going through the heat exchanger per time unit, $\Delta T$ = temperature increase of the air through the heat exchanger.

Thus, it can be seen that to increase $\Delta Q$, one of the quantities V or $\Delta T$ must be increased without simultaneously decreasing the other. Since, with all other factors remaining constant, $\Delta T$ is proportional (at first approximation) to the time interval that the air remains within the heat exchanger, it can be seen that to increase V, the air velocity must be increased but this decreases the time interval that the air is within the heat exchanger and as a result, decreases $\Delta T$ proportionately. Similarly, with all other factors remaining constant, an increase in $\Delta T$ can be obtained only at the expense of a proportional decrease of V.

In accordance with the present invention, the use of water as a heat transfer medium greatly increases Q by increasing K. For example, 9,423 BTUs are needed to vaporize a single gallon of water; and, since a fireplace can vaporize one to three gallons of water per hour with a moderate fire, with the same amount of air flow (60 $m^3$/hr), and air temperature increase and additionally one gallon of water being vaporized per hour, total heat transfer would increase from 2,226 to 11,649 BTUs/hr, an almost five-fold increase. With two gallons of water vaporized per hour, the total heat transfer would be 21,072 BTU's/hr, an almost ten fold increase.

Accordingly, it will be appreciated that by vaporizing water with heat from the fire, the efficiency of heat transfer is substantially increased due to the high specific heat of water. The change of state of the water from a liquid to a vapor requires substantial heat to be withdrawn from the fire thereby providing increased fuel efficiency. Of course, the heated air and vapor entering the room is humidified increasing the comfort index in the room such that, by using vaporized water along with forced air in the heat exchanger, increased heating efficiency and room comfort are simultaneously obtained.

Due to leaks in walls, around doors and windows, and air vents (flues), there is a continuous exchange between indoor and outdoor air of a house. With most fireplace heat exchangers, outdoor, cold dry air leaks into the house to cause discomfort and is drawn to the fire to sustain combustion and then is largely exhausted via the chimney. With the present invention, cold dry outdoor air is drawn into the fireplace via fan 32 and duct 25 with a portion used to sustain combustion and thereafter exhausted via the chimney and another portion passing through the heat exchanger to be heated and mixed with water vapor before being forced into the space to be heated. A positive pressure differential is thus created whereby warm moist air flows through the house before exiting to the outdoors.

It is noted that a portion of the heat exhausted up the chimney is recovered through the duct 25 disposed along the chimney such that cold air supplied to the heat exchanger is preheated. Since most of the heat transferred is carried by the water vapor, a lower fire temperature and, therefore, a smaller fire, can be used in the fireplace to obtain an adequate amount of heat transfer to the space such that a decreased amount of fuel is required.

From the above, it will be appreciated that heat transferred to the tubular grate heats the air flowing therethrough and the water partially filling the lower portion of the grate, the quantity of heat transferred to the water being many times greater than the heat transferred to the air. As a result of the heat transfer, the water vaporizes and mixes with the air and is forced out of the heat exchanger and into the space to be heated thereby greatly increasing the heat transfer to the space and the efficiency of the heat exchanger 10. Accordingly, the method and apparatus of the present invention provide increased heating efficiency while the apparatus is simple and inexpensive in construction and can be simply installed in existing fireplaces while eliminating the need for a separate humidifier.

Inasmuchas the present invention is subject to many variations, modifications and changes in detail, it is intended that all subject matter discussed above or shown in the accompanying drawings be interpreted as illustrative and not in a limiting sense.

What is claimed is:

1. Heat exchanger apparatus for use in a fireplace to heat a space, said apparatus comprising:

a tubular grate for holding fuel to be burned, said tubular grate comprising plural hollow tubes each having a hollow interior with a bottom portion adapted to contain liquid to be heated and vaporized by the burning of the fuel held by the grate such that there is an exposed surface of the liquid contained in the grate interior, said grate interior being further adapted to flow pre-heated air to be further heated by the burning of the fuel held by the grate through the grate interior in parallel through said hollow tubes and in direct contact with said exposed liquid surface such that the flowing air which is heated in said grate entrains liquid vapor from the exposed liquid surface;

means for pre-heating and supplying air to said hollow interior of said plural hollow tubes in parallel, said pre-heating means including a supply flow path disposed above said grate so as to be heated by combustion products from said fuel;

means for expelling the heated air and the entrained liquid vapor from the grate into said space; and liquid supply means for feeding a liquid to said bottom portion of said grate interior.

2. Heat exchanger apparatus as recited in claim 1 and further comprising air supply means for forcing air through said tubular grate.

3. Heat exchanger apparatus as recited in claim 2 wherein said liquid supply means includes means for maintaining a predetermined level of liquid in said bottom portion of said tubular grate.

4. Heat exchanger apparatus as recited in claim 3 wherein said bottom portion of said tubular grate includes a tubular member and said level maintaining means maintains said tubular member partially filled with liquid.

5. Heat exchanger apparatus as recited in claim 3 wherein said bottom portion of said tubular grate includes a plurality of tubular members communicating with a lower manifold, and said level maintaining means maintains said manifold and said tubular members partially filled with liquid.

6. Heat exchanger apparatus as recited in claim 5 wherein said tubular members of said tubular grate have upper portions communicating with an upper manifold for collecting and expelling heated liquid vapor and air to the space to be heated.

7. Heat exchanger apparatus as recited in claim 1 wherein said bottom portion of said tubular grate includes a plurality of tubular members communicating with a lower manifold and said liquid supply means includes means for maintaining a predetermined level of liquid in said tubular members and said lower manifold.

8. Heat exchanger apparatus as recited in claim 7 wherein said tubular members are arranged in parallel relation and have an elongated C-shape to define horizontal bottom and top legs and upstanding vertical legs extending therebetween and further comprising air supply means for supplying air to said lower manifold.

9. Heat exchanger apparatus as recited in claim 8 wherein said bottom legs communicate with said lower manifold and said upper legs communicate with an upper manifold disposed over and spaced from said lower manifold for collecting and expelling heated liquid vapor and air to the space to be heated, said air supply means includes a plenum communicating with and extending upward from said lower manifold and mounting said upper manifold, and said liquid supply means is disposed adjacent said plenum.

10. Heat exchanger apparatus as recited in claim 9 wherein said liquid supply means includes a reservoir, a tank disposed above said reservoir having an outlet communicating with said reservoir, float valve means in said reservoir floating on the liquid and cooperating with said tank outlet to maintain the level of liquid in said reservoir at a predetermined level, and passage means communicating with said reservoir and said lower manifold.

11. Heat exchanger apparatus for use in a fireplace to heat a space comprising:

a tubular grate for externally supporting fuel to be burned and for internally containing liquid to be heated such that there is an exposed liquid surface within the grate, for internally flowing air to be heated in direct contact with said liquid surface and thereby entrain liquid vapor in the flowing air, and for expelling the heated air and liquid vapor into the space to be heated, said tubular grate having a bottom interior portion for collecting the contained liquid;

liquid supply means for feeding a liquid to said bottom portion of said tubular grate whereby the liquid will be vaporized by the heat from fuel burned in said tubular grate and carried into the space to be heated by the flowing air heated in said tubular grate;

air supply means for forcing air through said tubular grate;

wherein said liquid supply means includes means for maintaining a predetermined level of liquid in said bottom portion of said tubular grate;

wherein said bottom portion of said tubular grate includes a plurality of tubular members communicating with a lower manifold, and said level maintaining means maintains said manifold and said tubular members partially filled with liquid;

wherein said tubular members of said tubular grate have upper portions communicating with an upper manifold for collecting and expelling heated liquid vapor and air to the space to be heated; and wherein said air supply means includes baffle means adjacent said lower manifold for supplying air below said tubular grate as well as therethrough.

12. Heat exchanger apparatus as recited in claim 11 wherein the fireplace has a flue and wherein said air supply means includes duct means extending through said flue to a location external of the space to be heated and fan means for directing air from said external location through said duct means, said lower manifold, said tubular grate and said upper manifold.

13. Heat exchanger apparatus for use in a fireplace to heat a space comprising:

a tubular grate for externally supporting fuel to be burned and for internally containing liquid to be heated such that there is an exposed liquid surface within the grate, for internally flowing air to be heated in direct contact with said liquid surface and thereby entrain liquid vapor in the flowing air, and for expelling the heated air and liquid vapor into the space to be heated, said tubular grate having a bottom interior portion for collecting the contained liquid;

liquid supply means for feeding a liquid to said bottom portion of said tubular grate whereby the liquid will be vaporized by the heat from fuel burned in said tubular grate and carried into the space to be heated by the flowing air heated in said tubular grate;

air supply means for forcing air through said tubular grate;

wherein said liquid supply means includes means for maintaining a predetermined level of liquid in said bottom portion of said tubular grate;

wherein said bottom portion of said tubular grate includes a plurality of tubular members communicating with a lower manifold, and said level maintaining means maintains said manifold and said tubular members partially filled with liquid;

wherein said tubular members of said tubular grate have upper portions communicating with an upper manifold for collecting and expelling heated liquid vapor and air to the space to be heated; and wherein said liquid supply means includes a reservoir, a tank disposed above said reservoir having an outlet communicating with said reservoir, float valve means in said reservoir floating on the liquid and cooperating with said tank outlet to maintain the level of liquid in said reservoir at said predetermined level, and passage means communicating with said reservoir and said lower manifold.

14. Heat exchanger apparatus as recited in claim 13 wherein said liquid supply means includes valve means controlling flow through said passage means.

15. Heat exchanger apparatus for use in a fireplace to heat a space comprising:

a tubular grate for externally supporting fuel to be burned and for internally containing liquid to be heated such that there is an exposed liquid surface within the grate, for internally flowing air to be heated in direct contact with said liquid surface and thereby entrain liquid vapor in the flowing air, and for expelling the heated air and liquid vapor into the space to be heated, said tubular grate having a bottom interior portion for collecting the contained liquid;

liquid supply means for feeding a liquid to said bottom portion of said tubular grate whereby the liquid will be vaporized by the heat from fuel burned in said tubular grate and carried into the space to be heated by the flowing air heated in said tubular grate;

wherein said bottom portion of said tubular grate includes a plurality of tubular members communicating with a lower manifold and said liquid supply means includes means for maintaining a predetermined level of liquid in said tubular members and said lower manifold; and air supply means for supplying air to said lower manifold for passage through said tubular grate and baffle means disposed in said lower manifold for directing some air below said tubular grate for combustion of fuel.

16. A heat exchanging method for heating a space from heat generated by fuel burned on a tubular grate in a fireplace comprising the steps of:

supplying liquid to the tubular grate to be vaporized by the heat generated in the fireplace;

containing the liquid in plural tubes of the tubular grate such that there is an exposed top surface of the contained liquid;

pre-heating air to be supplied to said grate by passing air through a flow passage disposed above said grate so as to be heated by combustion products of the fuel burned on the grate;

forcing the pre-heated air through the tubular grate tubes in parallel and in direct contact with the exposed top surface of the contained liquid to entrain the liquid vapor therein; and expelling the heated liquid vapor and air into the space to be heated.

17. A heat exchanging method as recited in claim 16 wherein said liquid supplying step includes partially filling a bottom portion of the tubular grate with water.

18. A heat exchanging method as recited in claim 17 wherein said liquid supplying step includes maintaining the level of water in the bottom portion of the tubular grate at a predetermined level.

* * * * *